United States Patent [19]

Leskinen

[11] 4,363,601

[45] Dec. 14, 1982

[54] IMPELLER IN A CENTRIFUGAL BLOWER

[75] Inventor: Seppo J. Leskinen, Västerskog, Finland

[73] Assignee: OY Nokia AB, Helsinki, Finland

[21] Appl. No.: 115,622

[22] Filed: Jan. 28, 1980

[30] Foreign Application Priority Data

Jan. 19, 1979 [FI] Finland ..... 790284

[51] Int. Cl.[3] ..... F04D 29/28

[52] U.S. Cl. ..... 416/188; 416/DIG. 3; 29/156.8 CF

[58] Field of Search ..... 416/186 R, 187, 188, 416/244 R, 244 A, DIG. 3; 29/156.8 CF

[56] References Cited

U.S. PATENT DOCUMENTS

| | | | |
|---|---|---|---|
| 892,262 | 6/1908 | Jaeger | 416/186 X |
| 1,873,974 | 8/1932 | Meyer | 416/186 R |
| 4,028,005 | 6/1977 | Eck | 416/186 R |

FOREIGN PATENT DOCUMENTS

| | | | |
|---|---|---|---|
| 1355428 | 2/1964 | France | 416/186 |

*Primary Examiner*—Leonard E. Smith

*Attorney, Agent, or Firm*—Dressler, Goldsmith, Shore, Sutker & Milnamow, Ltd.

[57] ABSTRACT

Disclosed is a centrifugal-blower impeller made from a back plate and a front plate and blades attached between these plates. The back plate or the front plate of the impeller or both of them are prestressed in a direction opposite to the stresses produced by centrifugal force when the impeller rotates. According to a preferred embodiment of the impeller the back plate is prestressed by means of a stressing member having the shape of a truncated cone, which is supported by the inner end of the hub of the driving shaft of the blower. In addition a stressing flange is attached to said hub and is tightened to the back plate by means of bolts. The front plate may be prestressed by means of a stressing ring mounted on the suction ring of the front plate.

12 Claims, 5 Drawing Figures

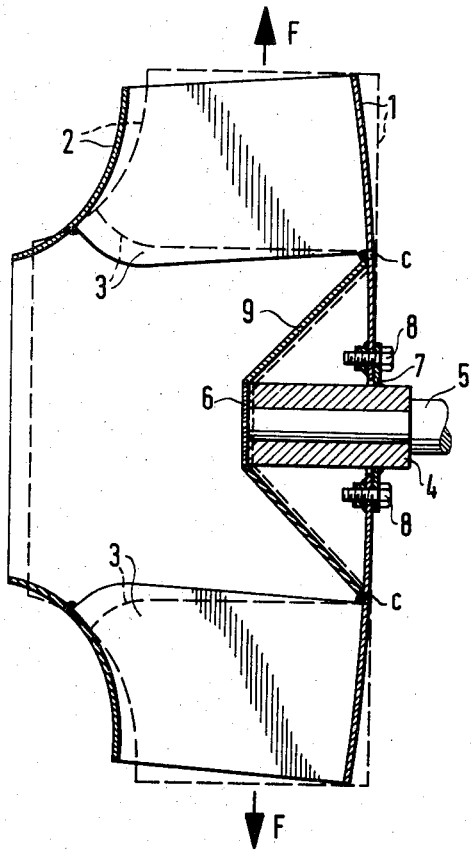
Fig. 3
Fig. 4a
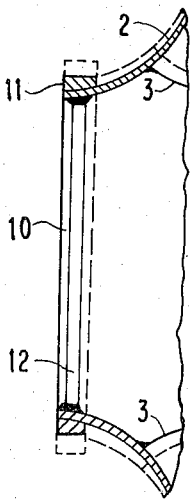
Fig. 4
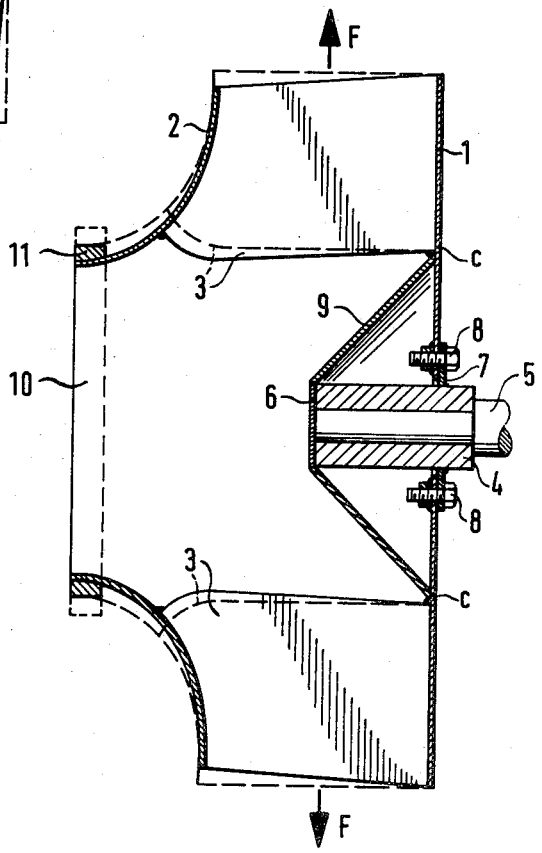

IMPELLER IN A CENTRIFUGAL BLOWER

BACKGROUND OF THE INVENTION

The present invention relates to an impeller in a centrifugal blower. The blower impeller consists of a back plate and a front plate, with blades attached between these by welding or by some other method.

When the impeller rotates, its parts tend to be deformed by centrifugal force. In addition to considerable elongations, the impeller bends owing to its asymmetry, whereby strong stress peaks are produced in certain parts, these stress peaks restricting the rotational velocity of the blower and thereby the pressure achievable by means of the blower. This is the case especially in high-pressure blowers.

SUMMARY OF THE INVENTION

In accordance with the invention, the impeller is prestressed in a direction opposite to the stresses produced during operation; the prestressing reduces the stresses, in particular stress peaks, produced during the rotation of the blower. In this case the impeller can be rotated at a higher speed and thereby a higher pressure can be achieved than with an impeller which has not been prestressed. According to the invention, the back plate or the front plate, or both, can be prestressed by means of stressing members. The characteristics of the invention are given in the accompanying claims.

Claim 2 discloses a preferred embodiment, in which a conical-flange stressing member mounted on the hub of the impeller is used for prestressing the back plate of the impeller. By adjusting the strength of the conical member according to the invention, the strength of the back plate, the flare angle of the cone, the degree of prestressing, and other such factors, different bending forms of the impeller can be produced and thereby the stresses due to centrifugal forces can effectively be compensated. However, angle pieces, tensile bars, and other such members can also be used for prestressing the back plate.

The front plate of the impeller can be prestressed advantageously in accordance with claim 3 by mounting a stressing ring at the suction opening of the front plate, and the front plate is compressed by means of this ring. This can also be effected by heating the stressing ring and/or by cooling the suction ring. The front plate can also be prestressed by means of a tensile bar fitted diametrically across the suction opening. The prestressing of the front plate according to the invention differs from the prestressing of the back plate described above in that the impeller as a whole does not bend considerably but compresses.

BRIEF DESCRIPTION OF THE DRAWINGS

Some preferred embodiments of the impeller according to the invention are described below with reference to the accompanying drawing:

FIG. 3 depicts the effect of prestressing on the deformation of the impeller, and FIGS. 4 and 4*a* depict the structure and the deformation of the impeller when both the back plate and the front plate are prestressed.

DESCRIPTION OF THE PREFERRED EMBODIMENTS

Figure 1:
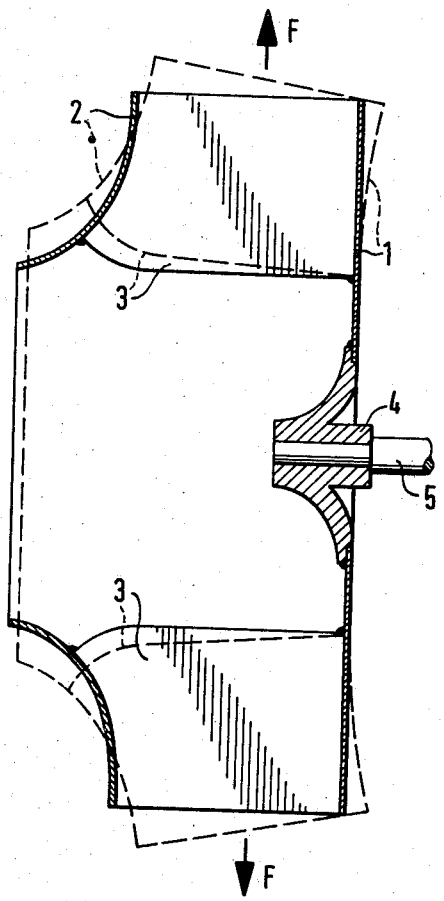
FIG. 1 in the drawing depicts the deformation of a non-prestressed impeller.

The impeller depicted in the figures consists of a back plate 1 and a front plate 2, with blades 3 attached between them by welding. The rotation is transmitted from the driving shaft 5 to the impeller via the hub 4.

Figure 2:
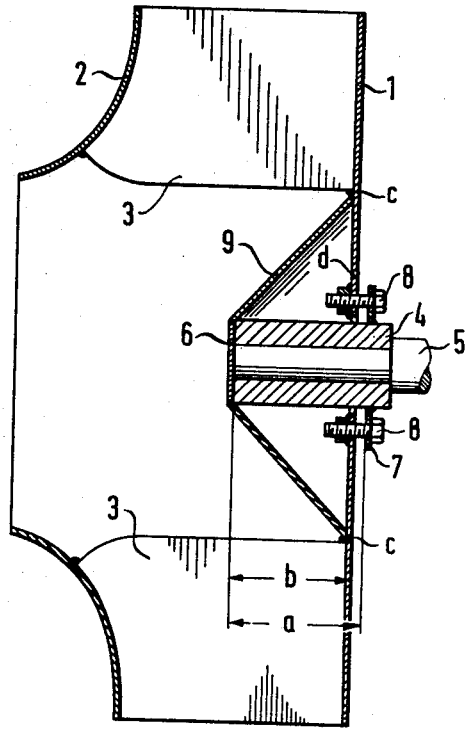
FIG. 2 depicts one structure suitable for the prestressing of the back plate of an impeller according to the invention.

When the impeller rotates, its parts tend to be deformed by centrifugal force F, as indicated by dotted lines in FIG. 1. According to one embodiment of the invention shown in FIG. 2, a part 9 having the shape of a truncated cone has been attached to point c in the back plate 1 of the impeller, and an end plate 6 has been attached to the end of this part 9. A stressing flange 7 has been attached to the hub 4, the distance a from the flange 7 to the inner end of the hub being greater than the distance b from the outer wall of the back plate to the inner end of the hub. The prestressing is achieved by tightening the flange 7 by means of bolts 8 to the back plate 1. The part 9 having the shape of a truncated cone pulls in this case the back plate 1 towards the front plate 2 at point c and the flange 7 pulls in the opposite direction.

In this manner, the impeller is bent and prestressed to the configuration shown in solid line in FIG. 3 from the configuration shown in dotted line, and is thus prestressed in a direction opposite to the bending caused by centrifugal force F.

The prestressing of the front plate 2 of the impeller is achieved according to FIG. 4 by means of a stressing ring 11 mounted on the suction ring 10 of the front plate after the assembly of the impeller. By tightening this ring, the front plate 2 can be compressed, as indicated by full lines in FIG. 4. Tensile stress is thereby produced in the stressing ring 11 and compressive stress in the front plate 2 and the blades 3, the compressive stress partly or totally cancelling the stresses produced by centrifugal force F during operation, as indicated by dotted lines in FIG. 4. In the structure according to FIG. 4, the back plate has also been prestressed in the manner described above.

FIG. 4*a* illustrates prestressing front plate 2 by means of a tensile bar 12 fitted diametrically across the suction opening.

What is claimed is:

1. A centrifugal-blower impeller assembly comprising:

a front plate, a back plate spaced from said front plate, a plurality of blades extending between and attached to said front and back plates, a hub attached to said back plate, and means for prestressing said back plate in a direction generally opposite to the stresses produced by centrifugal force when said impeller assembly rotates, whereby said back plate is in an initially prestressed condition prior to impeller operation.

2. An impeller assembly in accordance with claim 1 and means for prestressing said front plate in a direction generally opposite to the stresses produced by centrifugal force when said impeller assembly rotates.

3. An impeller assembly in accordance with claim 2, said means or prestressing said front plate including a stressing ring mounted on a suction ring portion of said front plate, said front plate being compressed by tightening said ring in order to prestress said front plate.

4. A centrifugal-blower impeller comprising a back plate and a front plate and blades attached between said plates, and prestressing means for prestressing at least one of said back plate and said front plate in a direction generally opposite to the stresses produced by centrifugal force when said impeller rotates, whereby at least one of said back plate and said front plate is in initially prestressed condition prior to impeller operation.

5. A centrifugal-blower impeller comprising a back plate and a front plate and blades attached between said plates, said back plate and said front plate being prestressed in a direction generally opposite to the stresses produced by centrifugal force when said impeller rotates by prestressing means including a part having the shape of a truncated cone being attached to the inner wall of said impeller back plate and around a hub of a driving shaft of said blower, an end portion of said part being supported by the inner end of said hub, a stressing flange being attached to said hub, the distance of said stressing flange from the inner end of said hub being greater than the distance from the outer wall of said back plate to the inner end of said hub, and said stressing flange being tightened to said back plate by means of bolts.

6. A blower impeller according to claim 5 wherein said prestressing means further include a stressing ring mounted on a suction ring of said front plate, said front plate being compressed by tightening said ring in order to prestress said front plate.

7. A blower impeller according to claim 4, wherein said prestressing means include a stressing ring mounted on a suction ring of said front plate, said front plate being compressed by tightening said ring in order to prestress said front plate.

8. A centrifugal-blower impeller assembly comprising:

a front plate, a back plate spaced from said front plate, a plurality of blades extending between and attached to said front and back plates, a hub attached to said back plate, and means for prestressing said back plate in a direction generally opposite to the stresses produced by centrifugal force when said impeller assembly rotates wherein said prestressing means include a prestressing part attached to the inner wall of said back plate, said part having a portion supported by said hub, and means for urging said hub inwardly of said back plate whereby said prestressing part stresses said back plate in a direction generally opposite to the stresses produced in said back plate by centrifugal force when said impeller assembly rotates.

9. An impeller assembly in accordance with claim 8, said means for urging including a prestressing flange attached to said hub outwardly of said back plate, and threaded fastener means connecting said prestressing flange to said back plate.

10. An impeller assembly in accordance with claim 9 and, means for prestressing said front plate in a direction generally opposite to the stresses produced by centrifugal force when said impeller assembly rotates.

11. An impeller assembly in accordance with claim 10, said means for prestressing said front plate including a stressing ring mounted on a suction ring portion of said front plate, said front plate being compressed by tightening said ring in order to prestress said front plate 12. An impeller assembly in accordance with claim 10, said means for prestressing said front plate including a tensile bar fitted diametrically across the suction opening defined by said front plate.

* * * * *